US005890333A

United States Patent [19]

Boroviak

[11] Patent Number: 5,890,333

[45] Date of Patent: Apr. 6, 1999

[54] CONCRETE FORM

[76] Inventor: Richard Boroviak, 233 Weybourne Road, Oakville, Ontario, Canada, L6K 2T7

[21] Appl. No.: 893,378

[22] Filed: Jul. 11, 1997

[51] Int. Cl.[6] ..... E02D 27/42; E04C 3/34

[52] U.S. Cl. ..... 52/292; 52/294; 52/720.1; 52/736.1; 52/745.17; 249/48

[58] Field of Search ..... 52/720.1, 292–297, 52/736.1, 745.17, 724.1, 721.1, 721.2, 742.14; 249/13, 18, 19, 51, 48

[56] References Cited

U.S. PATENT DOCUMENTS

| | | | |
|---|---|---|---|
| 1,334,519 | 3/1920 | Bushong | 52/295 |
| 2,296,352 | 9/1942 | Keller | 52/292 X |
| 4,673,157 | 6/1987 | Wells | 52/295 X |
| 5,271,203 | 12/1993 | Nagle | 52/296 X |

FOREIGN PATENT DOCUMENTS

| | | | |
|---|---|---|---|
| 281190 | 12/1927 | United Kingdom | 52/297 |

*Primary Examiner*—Carl D. Friedman
*Assistant Examiner*—Winnie D. Yip

[57] ABSTRACT

The present invention provides a concrete form comprising a housing having a foot portion and a leg portion. The leg portion of the housing has a top end and a bottom end. The leg portion of the housing consists of four equi-spaced identical semi-conical wall segments and four concave wall segments joining adjacent semi-conical wall segments to provide a generally truncated conical configuration with a rounded cross or four leaf clover horizontal cross section. The top and bottom end of the leg portion is open. The foot portion is an inverted dish shape. The dish shaped foot portion has an annular side wall and a top wall. The bottom end of the leg portion is coaxially connected to the top wall of the dish shaped foot portion. An opening is provided in the top wall of the dish shaped foot portion the same size and shape as the internal cross-section of the bottom end of the leg portion. The concrete form of the present invention because of its unique construction provides numerous advantages over conventional fiber tubes. It is easier to dig a hole into which the form can be inserted; the present invention will take about one third the volume of concrete that a similar sized fiber tube and due to its tapered construction, the concrete forms of the present invention will resist upward frost movement.

7 Claims, 3 Drawing Sheets

CONCRETE FORM

BACKGROUND OF THE INVENTION

1. Field of the Invention

This invention relates to concrete load bearing columns and, more particularly, to forms for forming concrete load bearing columns to hold posts in place and support the weight of the post.

2. Description of the Prior Art

The concrete foundation for residential decks and the like, anchors the entire structure against settling, slippage and wind lift. It also distributes loads into the ground and protects posts or beams from direct contact with the earth. The foundation may consist of two parts, a footing that distributes the load underground and a pier that raises the bottom of the post above grade or in many installations just one part the pier, performs both functions.

The size and depth of footings are governed by local building codes. Typical footings extend at least 6 inches below the frost line.

The piers can be cylindrical, rectangular or pyramidal with a flat top. The pier should hold the bottom of the post at least 2 inches above grade to protect it from decay. There are three basic methods of constructing the foundation: (1) casting a footing then placing a precast pier on it (2) casting both the footing and the pier using wooden forms and (3) using fiber tubes to cast a cylindrical column.

Fibre tubes generally come in 6", 8", 10" and 12" diameters and can be cut to any length. In utilizing fiber tubes some manufacturers recommend that a hole be dug twice as wide as the tube diameter. Local building codes specify the depth of the hole. Loose gravel (2 to 3 inches) may be provided in the bottom of the hole to provide drainage under the concrete footings. A four to six inch footing may then be optional poured into the bottom of the hole. The tube is cut at least 2 inches longer than the depth of the hole so that the column will be above ground level. The tube is placed in the hole and a level used to insure the top of the tube is level. Soil is then packed around the tube to hold it in place. Alternatively the tube is braced with light lumber. The tube is then filled with concrete and the concrete tapped into place using a long stick or bar to fill any air gaps. The concrete is levelled to the top of the tube. A beam or post anchor can then be inserted into the wet concrete at the center of the tube. After the concrete cures, any exposed portion of the tube is cut away with a utility knife.

For a 6"×48" tube two or more bags of concrete mix are usually required to fill the tube. An 8"×48" tube requires about three bags of concrete mix.

To store the tubes they are either stacked horizontally or vertically which requires considerable floor space and cargo space when the forms are transported to a site.

SUMMARY OF THE INVENTION

It is an object of the present invention to simplify the construction of concrete load bearing columns by taking less time and using less concrete.

It is a further object of the present invention to provide a form that resists any upward frost movement.

Thus, in accordance with the present invention, there is provided a concrete form comprising a housing having a foot portion and a leg portion. The leg portion of the housing has a top end and a bottom end. The leg portion of the housing consists of four equi-spaced identical semi-conical wall segments and four concave wall segments joining adjacent semi-conical wall segments to provide a generally truncated conical configuration with a rounded cross or four leaf clover horizontal cross section. The top and bottom end of the leg portion is open. The bottom end of the leg portion is connected to the foot portion. The foot portion is an inverted dish shape. The dish shaped foot portion has an annular side wall and a top wall. The bottom end of the leg portion is coaxially connected to the top wall of the dish shaped foot portion. An opening is provided in the top wall of the dish shaped foot portion the same size and shape as the internal cross-section of the bottom end of the leg portion.

The concrete form of the present invention is preferably blow moulded.

The concrete form of the present invention because of its unique construction provides numerous advantages over conventional fiber tubes. The design of the present form results in a load bearing capacity of the column equivalent to cylindrical columns with the same diameter as the foot portion. The concrete form of the present invention will take about one third the volume of concrete than a fiber tube with the same load bearing capacity. This not only provides savings in terms of material costs but also time as less concrete needs to be prepared.

Due to its tapered construction, the concrete forms of the present invention will resist any upward frost movement.

Because the concrete forms of the present invention have a smaller top diameter that fiber tubes with a similar load bearing capacity, it is easier to dig a hole into which the form can be inserted. When a hole is being dug manually it has a tendency to taper inwardly. The cylindrical fiber tubes generally require the user to start by digging a larger than the tube's diameter so that the bottom of the hole will be wide enough to accommodate the tube. The present invention's smaller top diameter requires less digging. In addition the tapered design of the leg portion means more of the dirt can be used to back fill the hole around the form. In many communities any excess dirt must be taken to landfills who charge for disposal. Less dirt left over means less dirt that may need to be delivered to landfills etc.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE PREFERRED EMBODIMENT

Figure 1:
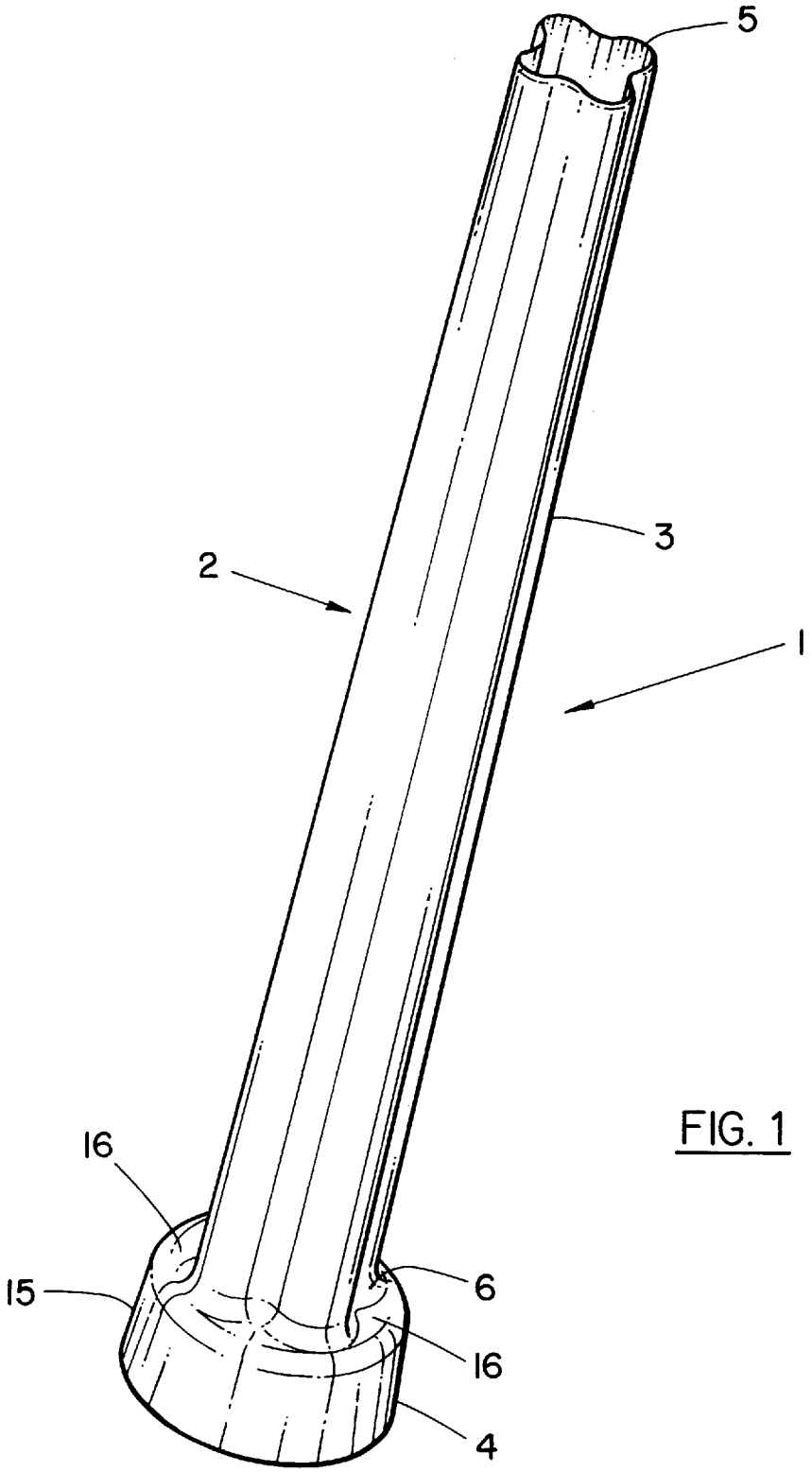
FIG. 1 is a perspective view of a concrete form of the present invention.
Figure 3:
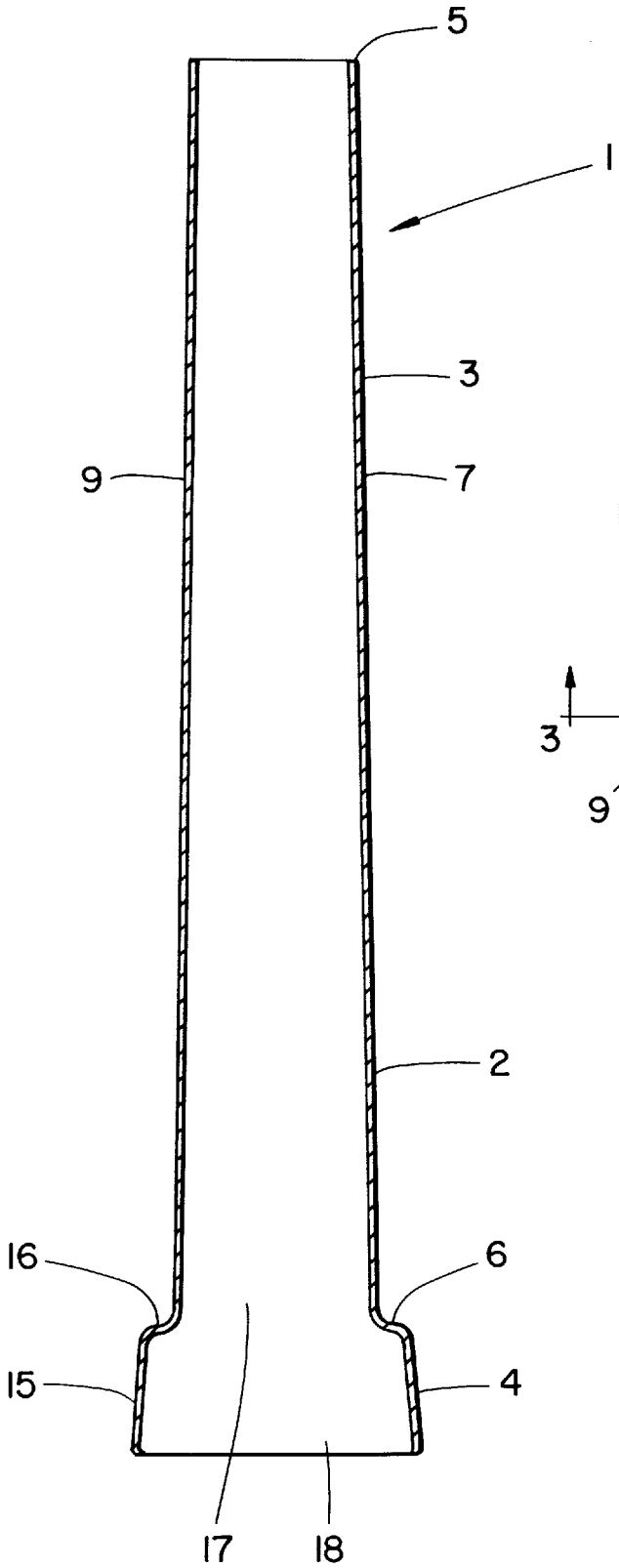
FIG. 3 is a longitudinal cross section view of the concrete form of along line A—A of FIG. 2.
Figure 2:
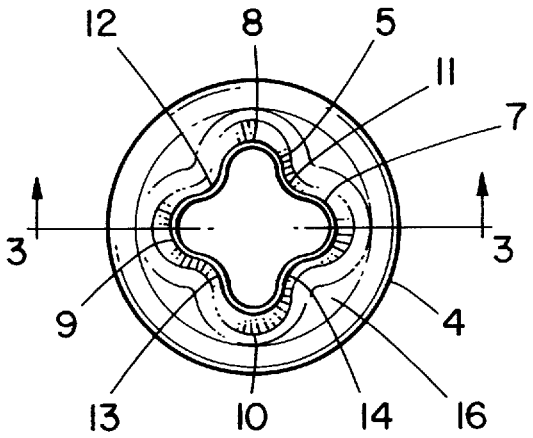
FIG. 2 is a top plan view of the concrete form of FIG. 1.
Figure 4:
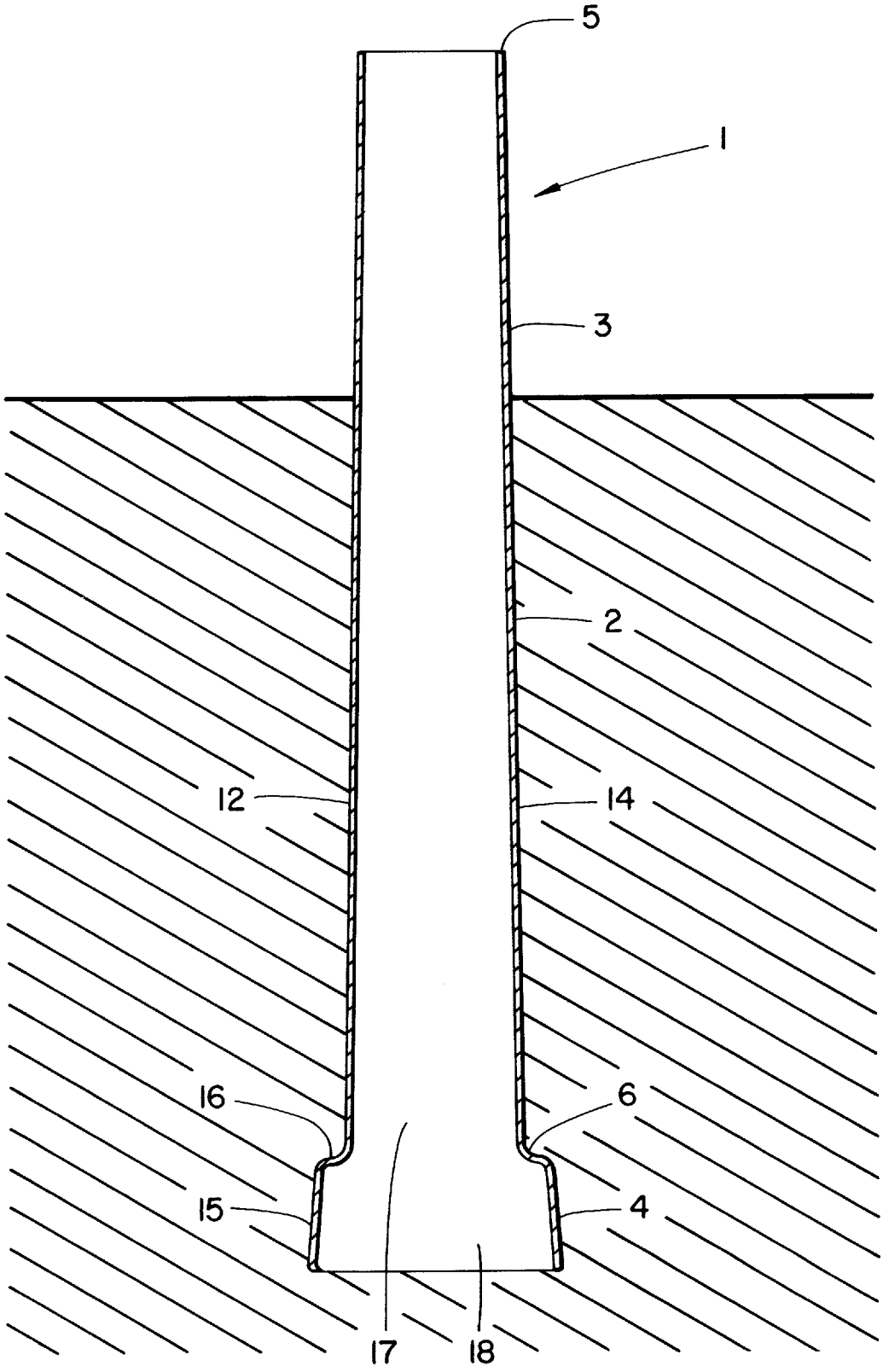
FIG. 4 is a longitudinal cross section view of the concrete form of along line B—B of FIG. 2.

Referring to FIGS. 1 to 4, a concrete form according to the present invention is generally indicated at 1. The form 1 comprises an open ended generally truncated conical housing 2 having a leg portion 3 and foot portion 4. The leg portion 3 has a top end 5 and a bottom end 6. The leg portion 3 of the housing 2 consists of four equi-spaced identical semi-conical wall segments 7, 8, 9 and 10 and four concave wall segments 11, 12, 13 and 14 joining adjacent semi-conical wall segments. The top end 5 and bottom end 6 of leg portion 3 are open.

The foot portion 4 of the housing 2 is shaped like an inverted dish surrounding the bottom end 6 of the leg portion 3. The dish shaped foot portion 4 has an annular side wall 15 and a top wall 16. The bottom end 6 of the leg portion 3 is coaxially connected to the top wall 16 of the foot portion 4. An opening 17 is provided in the top wall 16 of the foot portion 4 the same size and shape as the internal cross-section of the bottom end 6 of the leg portion 3.

This shape for the form when filled with concrete provides the necessary structural characteristics to support the load from a deck or the like, distribute the load to the ground and have sufficient strength to resist any sheer stresses placed on the pier. In the preferred embodiment shown it the drawings, the foot portion has a diameter of about 8 inches and a vertical compressive load capacity of 12,000 pounds.

In the preferred embodiment illustrated in FIGS. 1 to 4 the concrete form 1 is blow moulded of high density polyethylene with wall thicknesses of about 0.100 inches. The foot portion 4 has a diameter of 8.2" across the opening 18 and the annular side wall 15 tapers inwardly at a 5° angle to the top wall 16. The annular side wall 15 has a height of about 3.5".

The leg portion 3 of housing 2 in the preferred embodiment shown in the FIGS. has a maximum cross sectional diameter from segments 7–9 or 8–10 of approximately 5.8" and tapers inwardly over the length of the form of about 48" to a diameter of 4.65". The concave curved wall segments 11–13 and 12–14 have a cross sectional diameter of 3.75" tapering to 3". There is about a 10° to 2° taper from the top end 5 to the bottom end 6 of the leg portion 3.

The form is used in a conventional manner. A hole is dug to the depth required by local conditions. Gravel or concrete or both can be placed in the bottom of the hole. The foot portion of the form is inserted into the hole. The top end of the leg portion of the form is levelled and then dirt is filled in around the form to hold it in place. The form is then filled with concrete. If you are digging a hole less than 48" the top end of the leg portion of the form can be cut to provide sufficient height above grade to prevent decay of any post attached to the top of the resulting load bearing concrete column.

However the concrete form of the present invention because of its unique construction provides numerous advantages over conventional fiber tubes. The design of the present form results in a load bearing capacity of the column equivalent to cylindrical columns with the same diameter as the foot portion. An 8" cylindrical fiber tube requires about three 30 kg bags of concrete mix to fill a 48" section. On the other hand the form of the present invention in the size illustrated in FIGS. 1–4 with a similar load bearing capacity requires only one bag of concrete. This not only provides savings in terms of material costs but also time as less concrete needs to be prepared.

Due to its tapered construction, the concrete forms of the present invention will resist any upward frost movement.

Because the concrete forms of the present invention have a smaller top diameter than fiber tubes with a similar load bearing capacity, it is easier to dig a hole into which the form can be inserted. When a hole is being dug manually it has a tendency to taper inwardly. The cylindrical fiber tubes generally require the user to start by digging a hole wider than the tube's diameter so that the bottom of the hole will be wide enough to accommodate the tube and provide sufficient room between the form and the side of the hole to level the form. You need to provide at least an inch around the form to permit it to levelled. Accordingly when using a power post hole digger a 10 inch hole is dug for an 8 inch fiber tube. The present invention's smaller diameter for the leg portion enables sufficient room for levelling or adjustment of the form in the hole so that less digging is required ie the form shown in the FIGS. requires an 8 inch diameter hole vs a 10 inch hole for the corresponding fiber tube. In addition the tapered design of the leg portion means more of the dirt can be used to back fill the hole around the form. In many communities any excess dirt must be taken to landfills who charge for disposal. Less dirt left over means less dirt that may need to be delivered to landfills etc.

Also because of the tapered design it is possible to have one form nest between adjacent forms resulting in the ability to store and display the forms in substantial less space than with the conventional fiber tubes. The forms of the present invention can be shipped with thirty forms standing in rows and another layer of forms placed up side down between adjacent forms.

It will be appreciated that the above description related to the preferred embodiment by way of example only. Many variations on the invention will be obvious to those knowledgeable in the field, and such obvious variations are within the scope of the invention as described and claimed, whether or not expressly described.

What is claimed as the invention is:

1. A concrete form for forming a concrete foundation in a hole and provide a support above grade, said foundation having a footing base located below the frost line and a vertically upstanding load bearing column, said concrete form comprising an open ended generally truncated conical housing having a foot portion and an elongated leg portion, said leg portion having a top end and a bottom end and four equi-spaced semi-conical wall segments and four concave wall segments joining adjacent semi-conical wall segments, said foot portion of the housing is an inverted dish shape surrounding the bottom end of the leg portion, said foot portion having an annular side wall and a top wall wherein the bottom end of the leg portion is co-axially connected to the top wall of the foot portion.

2. A concrete form according to claim 1 wherein an opening is provided in the top wall of the foot portion the same size and shape as the internal cross-section of the bottom end of the leg portion.

3. A concrete form according to claim 2 wherein the concrete form is blow moulded.

4. A concrete form according to claim 1 having a vertical compressive load capacity of 12,000 pounds.

5. A concrete form according to claim 1 wherein the diameter of said foot portion is about eight inches.

6. A concrete form according to claim 5 wherein the bottom end of said leg portion has a diameter of five to six inches.

7. A concrete form according to claim 2 wherein the form is moulded from high density polyethylene.

* * * * *